US005588455A

United States Patent [19]

Kuo

[11] Patent Number: 5,588,455

[45] Date of Patent: Dec. 31, 1996

[54] SECURING RUNNER OF AN UMBRELLA

[76] Inventor: Cheng M. L. Kuo, No. 18, Alley 15, Lane 582, Sea Ta Road, Hsinchu, Taiwan

[21] Appl. No.: 645,815

[22] Filed: May 14, 1996

[51] Int. Cl.[6] ..... A45B 25/06

[52] U.S. Cl. ..... 135/28; 135/39; 135/41

[58] Field of Search ..... 135/28, 37, 38, 135/39, 40, 41, 42, 15.1

[56] References Cited

U.S. PATENT DOCUMENTS

| | | | |
|---|---|---|---|
| 769,877 | 9/1904 | Serge-Kisslow | 135/28 |
| 819,238 | 5/1906 | MacMillan | 135/28 |
| 1,202,063 | 10/1916 | Heyn | 135/41 |
| 2,567,284 | 9/1951 | Hacken et al. | 135/39 |
| 3,419,026 | 12/1968 | Evans, Jr. et al. | 135/41 X |
| 3,424,180 | 1/1969 | Andolfi | 135/39 X |
| 5,357,994 | 10/1994 | Chung | 135/40 X |
| 5,515,878 | 5/1996 | Wu | 135/28 |

*Primary Examiner*—Lanna Mai

*Attorney, Agent, or Firm*—Morton J. Rosenberg; David I. Klein

[57] ABSTRACT

The invention relates to an improved structure of a securing runner of an umbrella. The runner includes a sleeve, a nest, and a base, wherein the sleeve has an upper and a lower groove on one side related to a curved end and a holding end of a detent positioned in a main tube of the umbrella. The nest portion connecting with stretchers of the umbrella and the base are provided around the sleeve that the base has an inner circular rim to fit into a circular groove provided on lower part of the sleeve to obtain a good engagement between both. While the runner is pull downward, the sleeve urges the detent spring moving inwardly directly and the runner can be slid down to close the umbrella.

1 Claim, 6 Drawing Sheets

SECURING RUNNER OF AN UMBRELLA

SUMMARY OF THE INVENTION

A typical umbrella has a detent spring positioned in main tube of the umbrella to hold a runner and maintain the umbrella in an open position. In order to close the umbrella, a user must directly depress a holding end of the detent spring to urge the spring to move inwardly and in turn release the runner, closing the umbrella. During this operation, fingers of the user are usually trapped by the suddenly sliding runner and hurt. Hence, it is important to have an improvement on a prior art runner to provide better protection for users.

Therefore, the main object of the present invention is to provide an umbrella runner that provide a securing structure by which users can release the runner without directly touching the detent spring of the umbrella. The structure, features, and advantages of the present invention will be now described in detail with reference to the accompanying drawings.

DETAILED DESCRIPTION OF PREFERRED EMBODIMENTS

Figure 1:
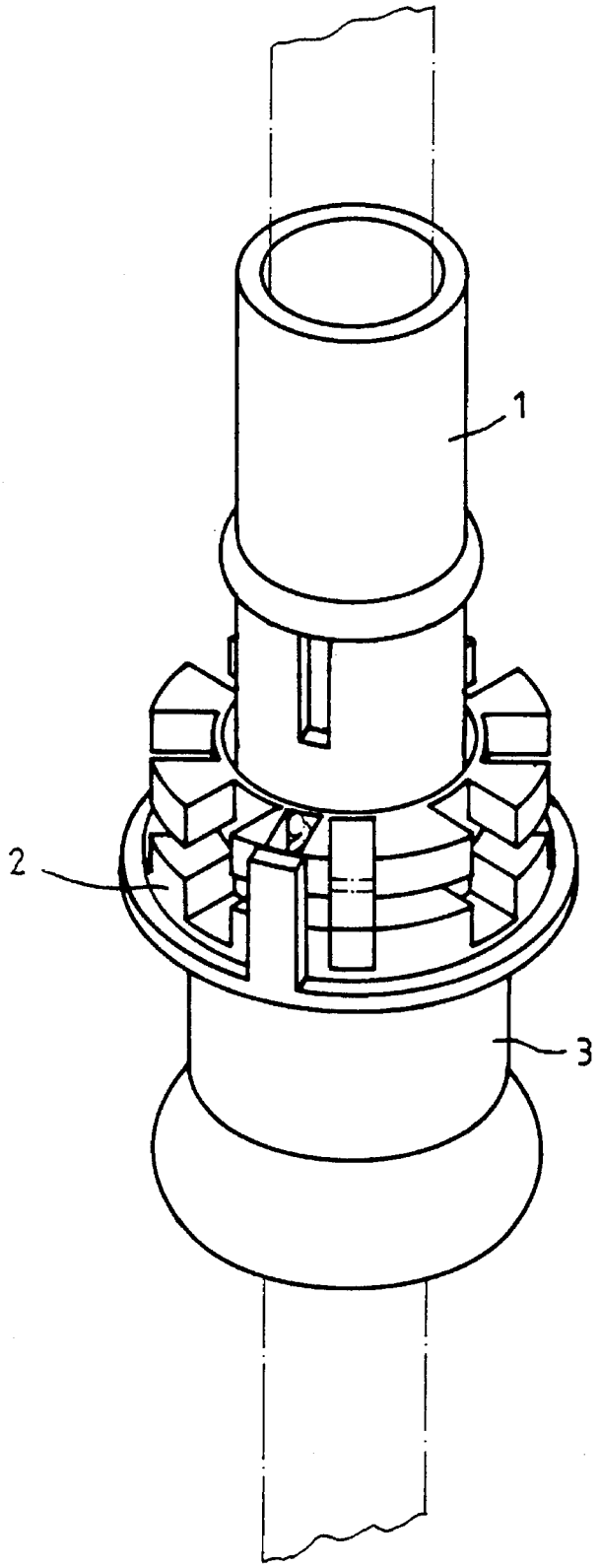
FIG. 1 is a perspective view showing a securing runner according to the invention.
Figure 2:
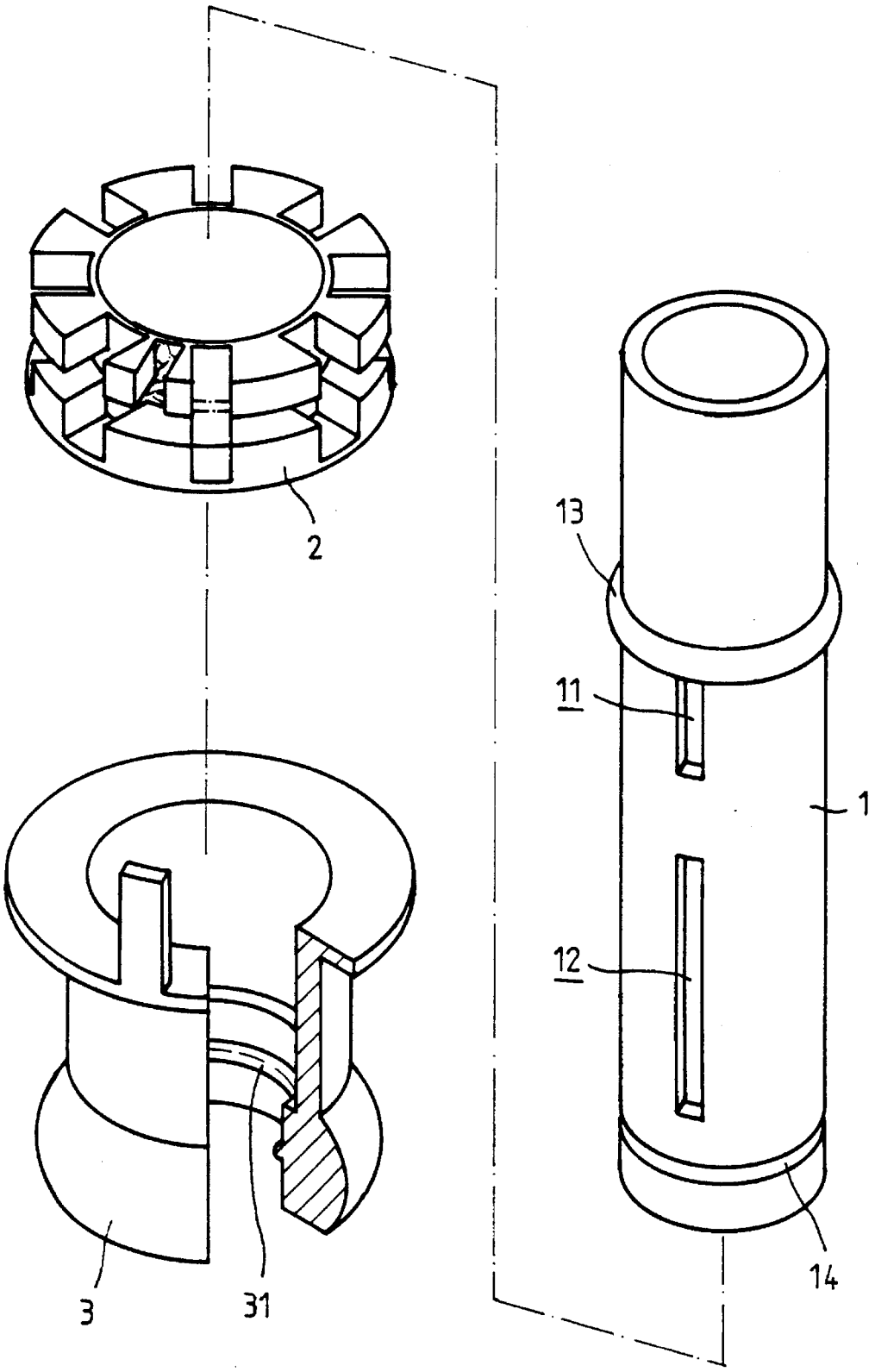
FIG. 2 is an exploded view of the securing runner shown in FIG. 1
Figure 3:
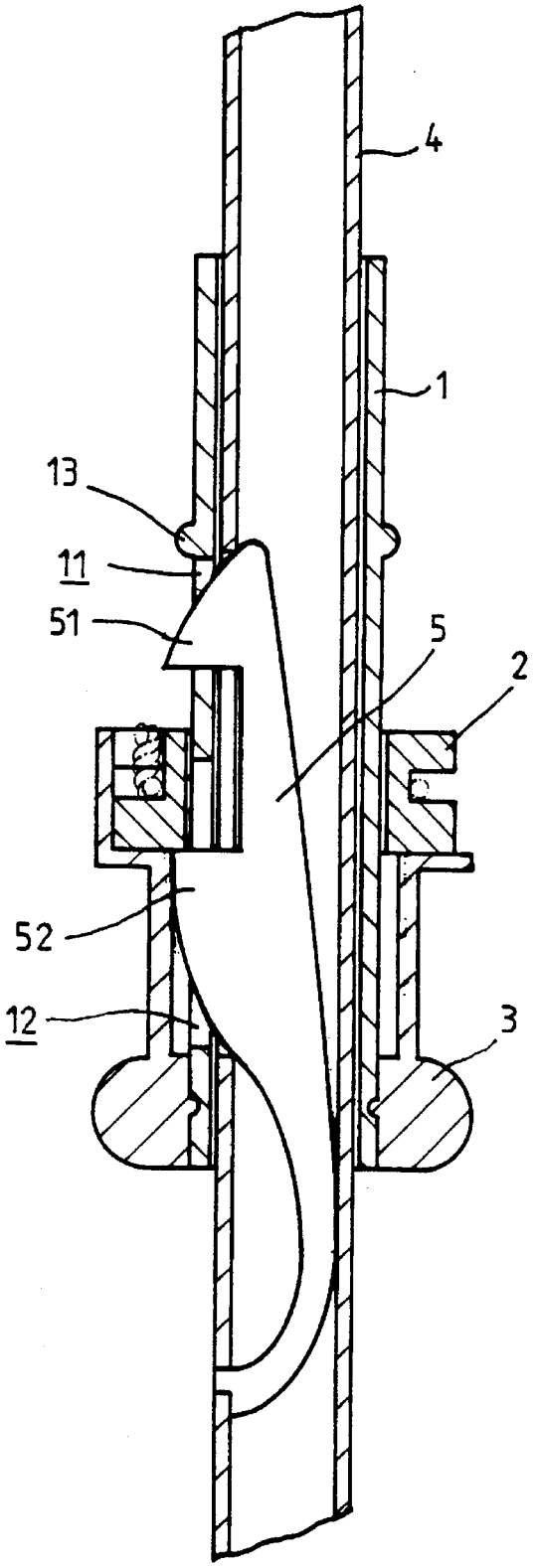
FIG. 3 is a cross sectional view of the securing runner accompanying with a main tube and a detent spring of an umbrella.
Figure 6:
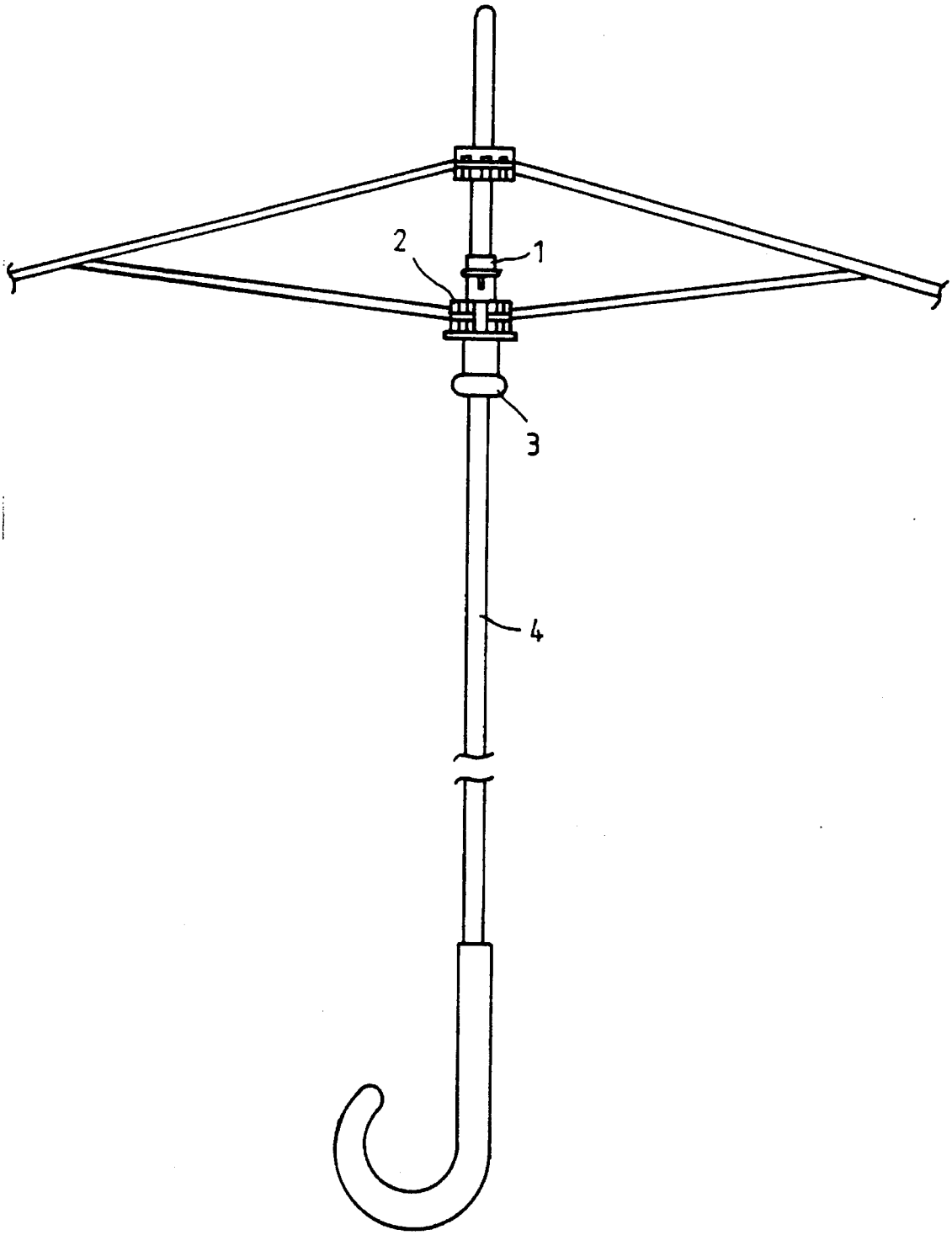
FIG. 6 is a plan view of an umbrella provided with the securing runner of the invention.

Referring to the FIGS. 1 to 3, there is shown a runner assembly according to the present invention including a sleeve (1), a nest portion (2), and a base (3). An upper groove (11) and a lower groove (12) are provided on a side of the runner (1) which has a circular projection (13) above the upper groove (12) and another circular groove (14) on lower part. The two grooves (11) and (12) are related to a curved end (51) and a holding end (52) of a detent spring (5) which is positioned in a main tube (4) of an umbrella. The nest portion (2) connecting with stretchers of the umbrella and the base (3) are provided around the sleeve (1). The base (3) has an inner circular rim (31) which is fitted on the circular groove (14) of the sleeve (1) that makes a good engagement between both. As shown in FIGS. 3 and 6, the umbrella is steady in open position because the bottom of the nest portion (2) is stopped by the holding end (52) of the detent spring (5).

Figure 4:
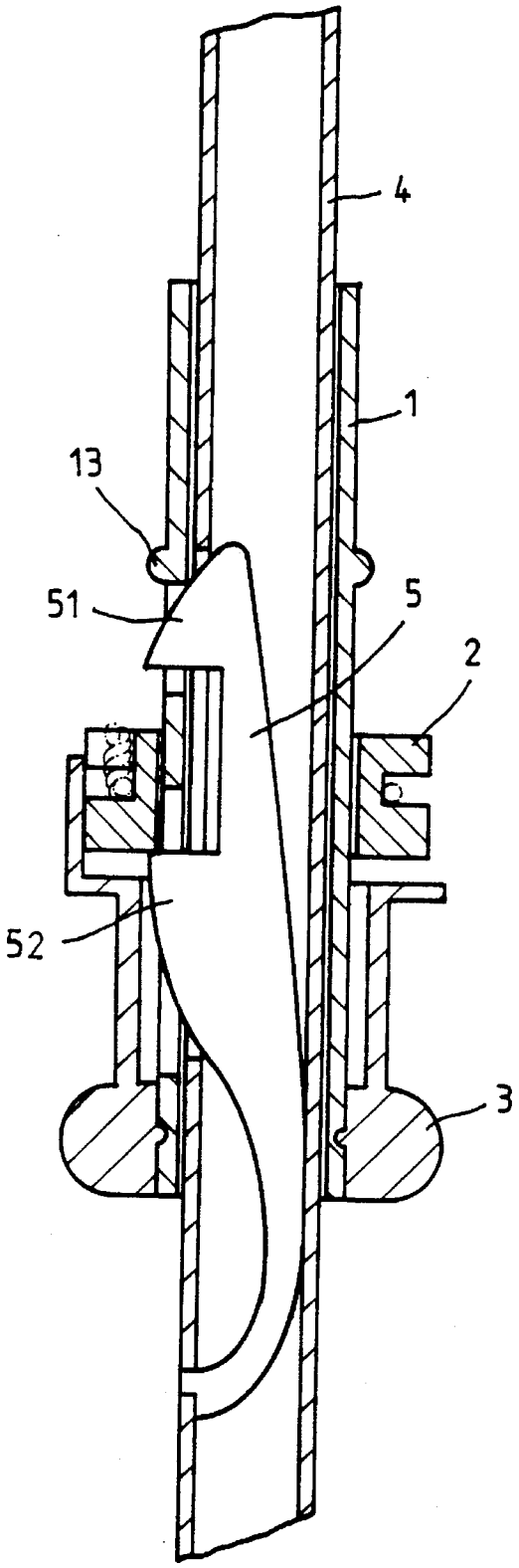
FIG. 4 is anther cross sectional view of FIG. 3 showing a downward movement of the runner.
Figure 5:
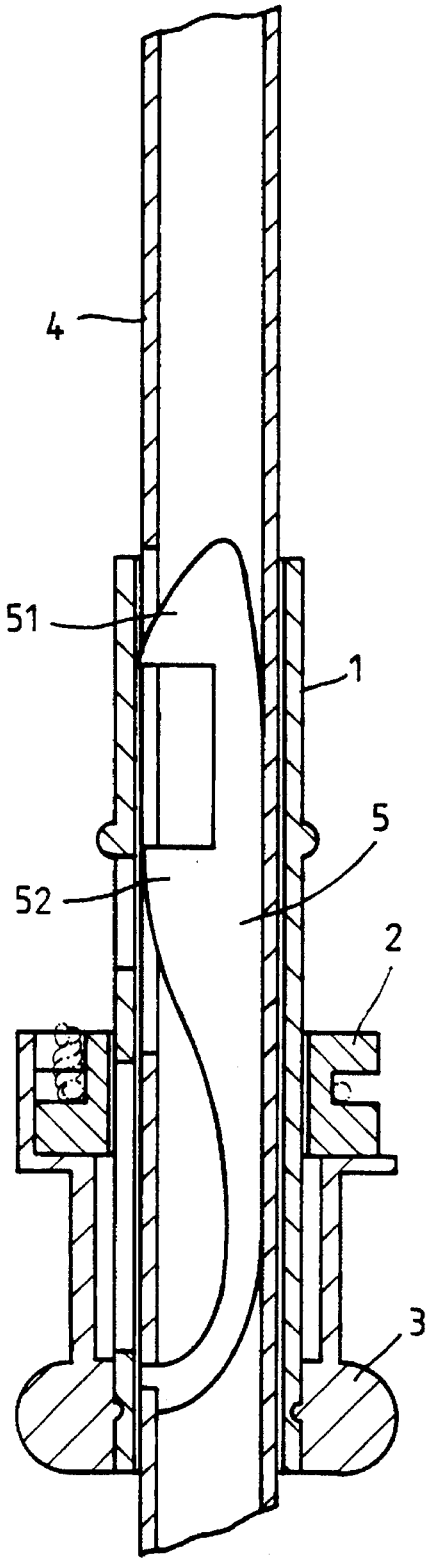
FIG. 5 is a further cross sectional view of FIG. 3 showing a completed downward movement of the runner.

Please referring to FIGS. 3 through 5, when to close the umbrella, a user can only pull down the runner to urge top end of the upper groove (11) depressing the curved end (51) of the detent spring (5) making the spring (5) and so as the holding end moving inwardly.

Thus, the runner is not stopped and can be slid down to close the umbrella.

During this operation, we can find that users can close the umbrella provided with the securing runner according to the present invention without touching the detent spring directly. Hence, the runner of this invention eliminates the possibility of trapping and hurting fingers of users. It attains an main effect of safety in this invention.

What is claimed is:

1. A securing runner of an umbrella including a sleeve, a nest portion, and a base; wherein the sleeve has an upper groove and a lower groove on one side related to a curved end and a holding end of a detent positioned in a main tube of the umbrella; the nest portion connecting with stretchers of the umbrella and the base being provided around the sleeve that the base has an inner circular rim to fit into a circular groove provided on lower part of the sleeve to obtain a good engagement between both; and while the runner being pull downward, the sleeve urges the detent spring moving inwardly directly and the runner can be slid down to close the umbrella.

* * * * *